US006711978B2

(12) United States Patent
Gambini

(10) Patent No.: US 6,711,978 B2
(45) Date of Patent: Mar. 30, 2004

(54) CUTTING HEAD FOR SEVERAL ROLLS OF KITCHEN TOWEL AND/OR TOILET PAPER

(76) Inventor: Giovanni Gambini, Via A. Omodeo 7, I - 56100 Pisa (IT)

( * ) Notice: Subject to any disclaimer, the term of this patent is extended or adjusted under 35 U.S.C. 154(b) by 161 days.

(21) Appl. No.: 09/865,117

(22) Filed: May 24, 2001

(65) Prior Publication Data

US 2001/0047705 A1 Dec. 6, 2001

(30) Foreign Application Priority Data

Jun. 1, 2000 (IT) ..... MI2000A1227

(51) Int. Cl.[7] ..... B26D 1/14
(52) U.S. Cl. ..... 83/471.1; 83/490
(58) Field of Search ..... 83/471.1, 327, 83/329, 330, 490, 484, 647.5

(56) References Cited

U.S. PATENT DOCUMENTS 3,491,637 A * 1/1970 Hasten et al. ..... 83/490
3,773,269 A * 11/1973 Brooks et al. ..... 83/490
4,041,813 A 8/1977 Spencer
RE30,598 E * 5/1981 Spencer ..... 83/327
4,584,917 A * 4/1986 Blom ..... 83/329
5,557,997 A * 9/1996 Wunderlich et al. ..... 83/327
5,799,555 A * 9/1998 Biagiotti ..... 83/329
6,330,848 B1 * 12/2001 Nishio et al. ..... 83/62.1

FOREIGN PATENT DOCUMENTS

WO WO 93/24287 12/1993

OTHER PUBLICATIONS

EPO Search Report.

* cited by examiner

*Primary Examiner*—Stephen Choi
(74) *Attorney, Agent, or Firm*—Hedman & Costigan, P.C.

(57) ABSTRACT

A cutting head for rolls (12) of kitchen towel or toilet paper, positioned on a cutting machine (11) on which at least two rolls (12) are conveyed step by step by a pusher conveyor, the cutting head (17) being connected to a motorized cutting disc (20), the cutting head (17) cutting the rolls (12) crosswise, the rolls (12) being set on a surface of a conveyor (14), where the rolls (12) are guided through grooves (13), wherein the cutting head (17) is connected to a rotary arm (26) affixed to sleeve (24) which is affixed to a supporting structure (21), the cutting head (17) further comprising a rotary shaft (47) for at least one cutting disc (20).

10 Claims, 5 Drawing Sheets

CUTTING HEAD FOR SEVERAL ROLLS OF KITCHEN TOWEL AND/OR TOILET PAPER

The present application claims priority to Italian Patent Application Serial No. MI 2000A 001227, filed Jun. 1, 2000.

BACKGROUND OF THE INVENTION

The present invention refers to a cutting head for several rolls of kitchen towel and/or toilet paper.

It is known that, for the production of rolls of kitchen towel and/or toilet paper, starting from batons or wound rolls of a predetermined diameter and of a certain height, e.g. approximately two meters, and known as logs, they must be cut so as to produce single rolls, e.g. approx. 200 mm in length, ready for distribution.

Presently, the cutting of these final rolls to the predetermined measurement is carried out on special cutting machines which receive, for example, the single log and cut it in sequence into a large number of shorter rolls, each of the required size. The log, upon completion of its take up reaches a pusher conveyor, which sets it out underneath a cutting machine.

In general, such a machine includes a motorized cutting disc on an arm which rotates, passing from a release position of one or two underlying logs, advanced on the conveyor, to a take up position to cut one or more rolls from the respective logs and so on.

Based on this working pattern, the disc engages with the logs or rolls to be cut, at most four underlying logs, according to strictly circular trajectories which limit the diameter of the logs to be cut because of possible problems of interference between the parts. Since the logs are set according to a chord as regards the revolution circumference of the disc, the middle logs are engaged with the cutting blade to a greater extent. As the cutting blade thickness increases towards the centre, an uneven cut is produced and the blade overheats.

To accelerate such parting operations, cutting machines are also produced which actually follow the log or logs during their advancement on the pusher conveyor and cut them while moving to save time.

However, such devices are particularly complex and must be perfectly adjusted so as to not cut different sized or imperfectly cut rolls which do not match user requirements. In addition, they present the same problems of the aforesaid rotary arm devices.

SUMMARY OF THE INVENTION

The object of the present invention is to produce a cutting head for several rolls of kitchen towel and/or toilet paper which solves the previously mentioned problems.

Another object of the present invention is to produce a log cutting head that is extremely simple and practical, while allowing a fast cutting operation with high productivity.

Another object of the present invention is to produce a log cutting head that allows discs to be used up until a fairly limited diameter, with cost savings and fewer interruptions proving necessary for disc replacement.

These and other objects, according to the present invention, are reached by producing a cutting head for several rolls of kitchen towel and/or toilet paper positioned on a cutting machine (11) on which at least two rolls (12) are conveyed step by step by a pusher conveyor, said cutting head (17) being connected to a motorized cutting disc (20), said cutting head (17) cutting said rolls (12) crosswise, said rolls (12) being set on a surface of a conveyor (14), where said rolls (12) are guided through grooves (13), wherein said cutting head (17) is connected to a rotary arm (26) affixed to sleeve (24) which is affixed to a supporting structure (21), said cutting head (17) further comprising a rotary shaft (47) for at least one cutting disc (20), said rotary shaft (47) of said cutting disc (20) being rotated by a motor (38) connected to said rotary shaft (47) by a set of gears (45, 46, 48) are supported and are eccentrically movable in relation to a drive shaft (32) while carrying out a cutting operation according to a synchronous ratio, said drive shaft (32) transmitting rotation to said cutting disc (20) and being parallel to a rotational central shaft (22) of said rotary arm (26).

Further characteristics are envisaged in the dependent claims.

BRIEF DESCRIPTION OF THE DRAWINGS

The characteristics and advantages of a cutting head for several rolls of kitchen towel and/or toilet paper, according to the present invention, will become apparent from the description that follows, supplied simply as explanatory and non-limiting, referring to the schematic drawings, in which.

DETAILED DESCRIPTION OF THE INVENTION

Figure 1:
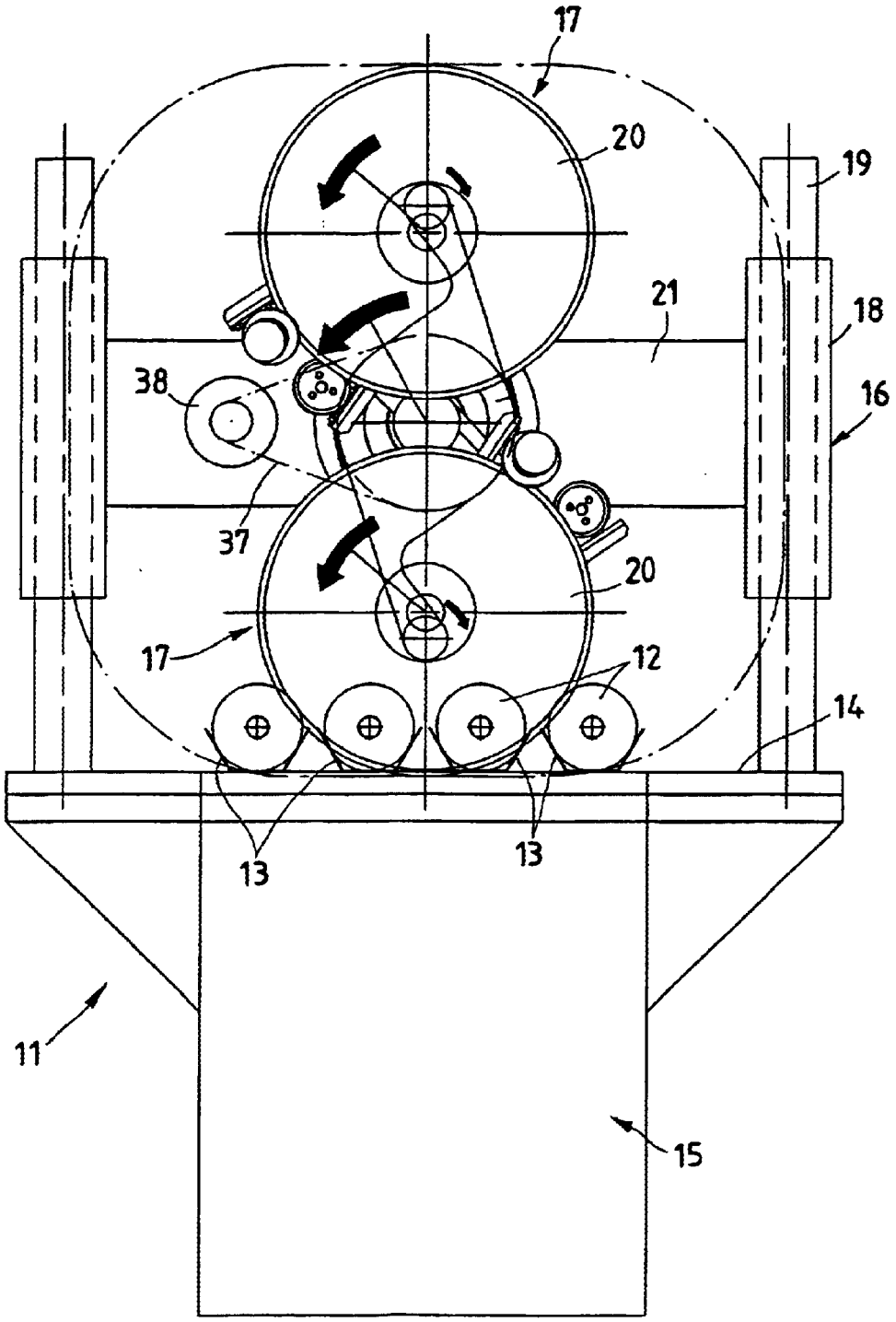
FIG. 1 is a schematic front view of a two head cutting for rolls of kitchen towel and/or toilet paper according to the present invention assembled on a cutting machine.

In FIG. 1 is shown a cutting machine for several rolls of kitchen towel and/or toilet paper indicated as a whole by 11, being equipped with two heads according to the invention.

The cutting machine 11 is positioned below a pusher conveyor (not shown) which supplies logs 12, for instance using pushers, to be cut to the predetermined measurement in a succession of rolls. In the example, the feed is according four grooves 13 positioned on a surface of the conveyor 14. In the example, the feed provides step by step advancement of predeterminable quantities of logs to be cut. Then, pressing parts (not shown) are in general envisaged which hold the logs 12 and engage on these, when they have been advanced a certain amount under the cutting machine 11.

The cutting machine 11 may include a lower supporting structure 15 and an upper portal structure 16, which can be raised and/or lowered in relation to the lower structure 15.

The portal structure 16, which has two cutting heads 17 of the cutting machine has rectangular section hollow guides 18 able to slide on I-beam uprights 19 which extend upwards, fixed to the lower structure 15 and height adjustable according to requirements. In this manner, it is possible to adjust the position of the cutting discs 20 of the two heads 17 depending on the diameter of the logs 12 and the diameter of the cutting discs 20. This portal structure 16 is appropriately moved and operated with centralized controls, not shown. In any case, it is possible to set the cutting heads of the invention also on a fixed structure, for example on a fixed crossbeam 21.

Instead, in the example shown, the crossbeam 21 connects the hollow guides 18 and supports a ratiomotor 23 which rotationally controls a central shaft 22.

On a sleeve 24 fixed to the crossbeam 21 and externally coaxial to central shaft 22, which goes through to its interior, is supported a rotary arm 26, with the interposition of bearings 25, which bears the pair of cutting heads 17 of the cutting machine 11. In the example, the rotary arm 26 extends from opposite sides in relation to said central shaft 22 and bears two heads, but a simplified machine could also have just one head. This rotary arm 26, at its free, opposite ends bears, by bearings 27, a shaped case 28 equipped with a sleeve extension 29 which bears a belt pulley 30 constrained at one of its free ends, which is integral with it. The belt pulley 30 and the shaped case 28 in turn support, by additional bearings 31, a drive shaft 32 which transmits the rotation to the cutting disc 20, parallel to the rotation central shaft 22 of the rotary arm 26. The drive shaft 32 which transmits the rotation to the cutting disc 20 in turn bears an additional belt pulley 33 constrained at one of its free ends, which draws the motion through belt 34 from a pulley 35 placed externally coaxial to the sleeve 24 fixed to the crossbeam 21 and on the same rotation due to the presence of bearings 36.

The pulley 35 is integral with a second pulley 35*a* joined and constrained to it, this also set on bearings 36, and fit to receive the motion through a timing belt 37 controlled by a motor 38 integral with the crossbeam 21. The pulleys 35 and 35*a* act as transmission, concentrically set at the rotation fulcrum of the rotary arm 26.

Also to be noted is the presence of a pulley 39 fixed and placed externally coaxial to the sleeve 24, fixed to crossbeam 21, on which passes a timing belt 40 which thus causes the case 28 to rotate around the drive shaft 32. Naturally, idle tension rollers are envisaged 41 and 42, respectively for the belts 40 and 34 positioned on the rotary arm 26.

It must not be forgotten that the rotary arm 26 is rotationally dragged by the central shaft 22 due to the presence of a transmission flange of the motion 43 placed at the end of the central shaft 22 and constrained at an external support 44 by bearings 25 which bear the same rotary arm.

Returning to each of the cutting heads 17 it should be noted that the drive shaft 32 which transmits the rotation to the cutting disc 20 bears a gear 45, at its other free end, opposite that where the pulley 33 is positioned, which in turn meshes with a second gear 46, eccentric in relation to drive shaft 22. The gears 45 and 46 are oil-bath lubricated in the shaped case 28. A lay shaft 47, the proper drive shaft of the cutting disc, bears this second gear 46, and is this which goes into an epicyclic reduction gear 48, with differential function, at the exit of which is supported the cutting disc 20. Both the pair of gears 45 and 46 as well as the reduction gear 48 are housed within the shaped case 28 which turns around drive shaft 32 which transmits the rotation to the cutting disc 20.

The rotary arm 26 thus bears two eccentric cutting heads 17, at its diametrically opposite ends, which turn at a synchronous ratio of 4:1 in relation to the rotation of the same arm around its own axes 47. The shaped case 28 is supported by bearings 27 and motorized by the timing belt transmission 40 and belt pulleys 30, 39 with a 4:1 ratio in relation to the rotation of arm 26. It should be noted that the motion of eccentric rotation of cases 28 or heads 17 is indeed conferred by the rotation of arm 26.

In fact, the pulley 39 is locked on the sleeve 24, or on the rotation fulcrum of the same arm 26.

Figure 5:
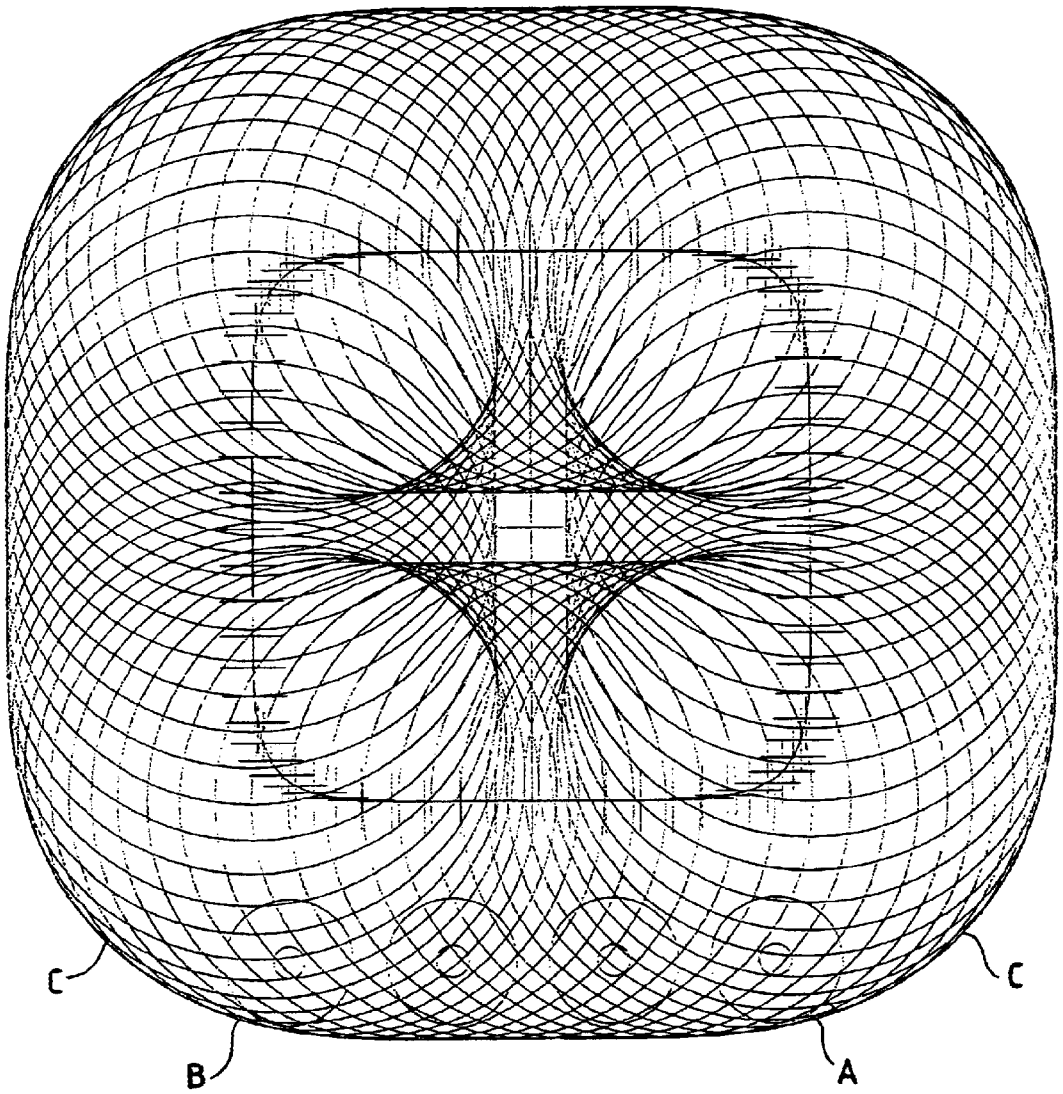
FIG. 5 is a schematic view of the course covered by the blades with the head of the invention.

With such a structure of each of the heads 17 set on rotary arm 26 each cutting disc is operated to make a closed ring course with four flattened sides, as in that shown in FIG. 5.

In the lower part of such course, a virtually straight section and parallel to the conveyor 14 surface, denoted by A to B in the section covered, the disc 20 acts on the underlying logs 12 set in grooves 13, cutting rolls (not shown) of the previously defined and chosen measurement.

The example shows how said two heads 17, set on the rotary arm 26, each bearing a disc or blade 20, intervene consecutively after the cutting action of one of the discs on the stationary logs, the logs advance and these advanced logs are cut by the other disc to the predetermined size. In this way the discs are cooled between one cut and another with improved cutting quality.

It is clear that disc sharpening systems, protection for the rotating and moving parts and adjustment units for the logs and rolls thus obtained are possible for completion of the machine.

It is superfluous to say that the cutting heads of the present invention, once joined to a cutting machine, allow the same to function without interruption. In fact, the rotation of the rotary arm, bearing any number of discs or blades, ensures continuous operation of the machine.

Advantageously, the discs exert their cutting action on the virtually straight A–B section of the closed flattened ring course with a restricted curved entry and exit space C, resulting in an improvement in the cutting quality. This is without doubt due to the geometry of the cutting trajectory and the slower advancement speeds of the disc in the material, due to the shorter run required for each cut. Furthermore, due to the straight trajectory the cutting disc or blade rim in use is less and constant.

In fact, the known rotary arm cutting machines cut according to an arc of a circle which, upon contact with the logs, generates a circular cut trajectory with gradual log contact, a variation in the blade or disc thickness and a partially correct cut. To be able to cut, for example, many logs or rolls it is necessary to have a particularly large rotation circumference of the arm which gives increased cutting speeds to the detriment of the quality of the product obtained. These problems increase with a reduction in diameter of the cutting disc through wear. The present invention can avoid all this due to the collaboration of movements at the prefixed synchronous ratios.

Moreover, it is possible based exactly on the contact according to an almost straight course of the cutting disc during its operating stage to work on logs of greater diameter without problems of interference with machine parts and intolerable variations in thickness of the disc areas coming into contact with the log to be cut, as happens with the rotary arm machines known until now. In this manner, one can work with discs of reduced diameter on logs of a certain diameter, which was not possible with the previous machines.

With this head applied on a cutting machine one also makes the cut according to several grooves for various logs simultaneously, with increased productivity. Such an operation is not possible with a rotary arm according to a circular trajectory which presents operating limits due to its geometry and cannot work on more than three-four logs simultaneously.

In any case, it is possible to use also more discs than those indicated simply by replacing the diametrical arm with a cross arm.

If the possibility exists of height adjustment of the upper portal structure 16, movable up and/or down in relation to the lower structure 15, then adjustment of the distance both depending on the diameter of the logs 15 as well as on the diameter of the cutting disc is possible. Actually, by lowering the upper portal structure 16 it is possible to fully exploit the cutting discs 20 with a gradual reduction in diameter due to the cuts made.

Figure 2:
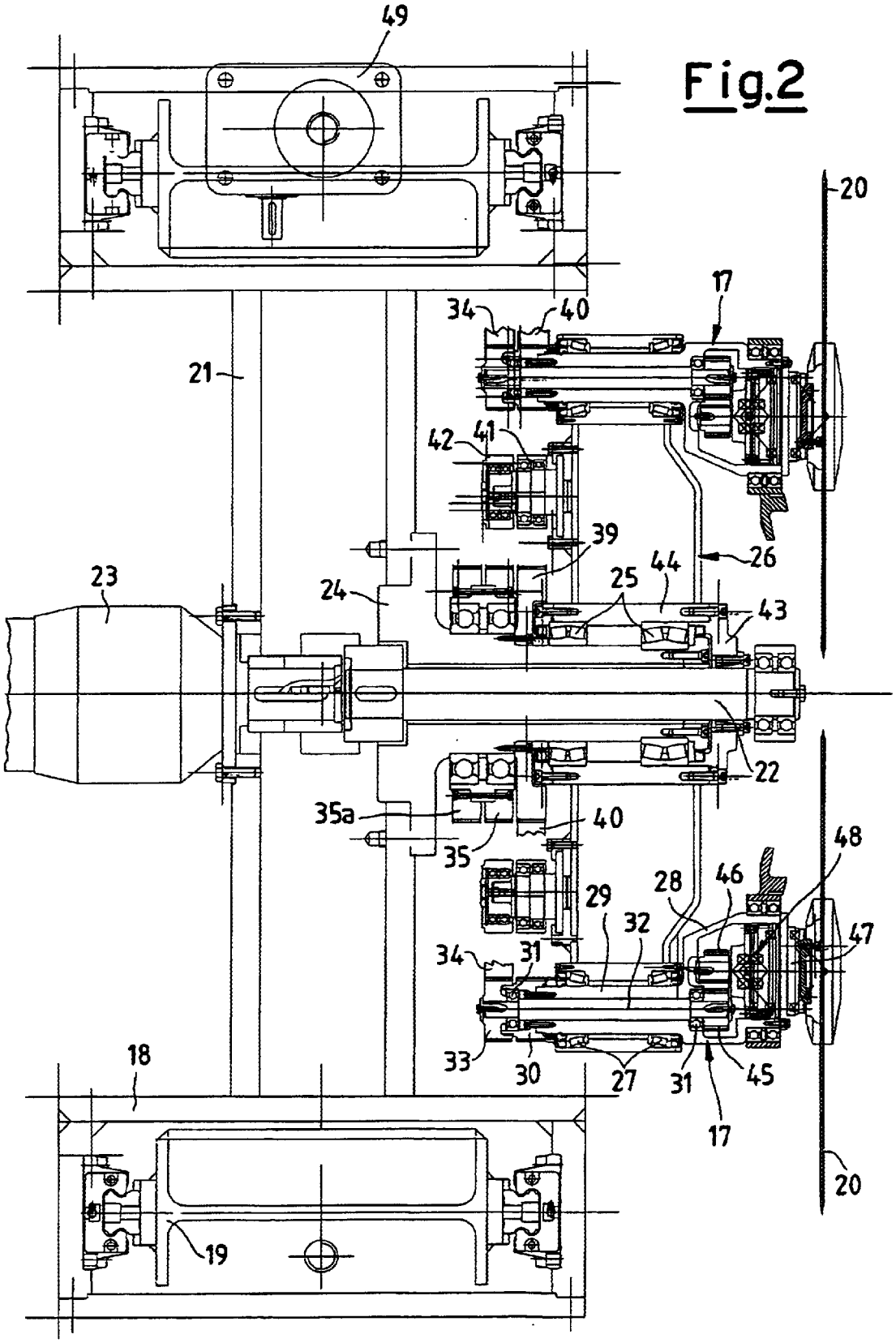
FIG. 2 is a plan view from above of a part of the machine in FIG. 1 with sections of the two heads according to the invention.
Figure 3:
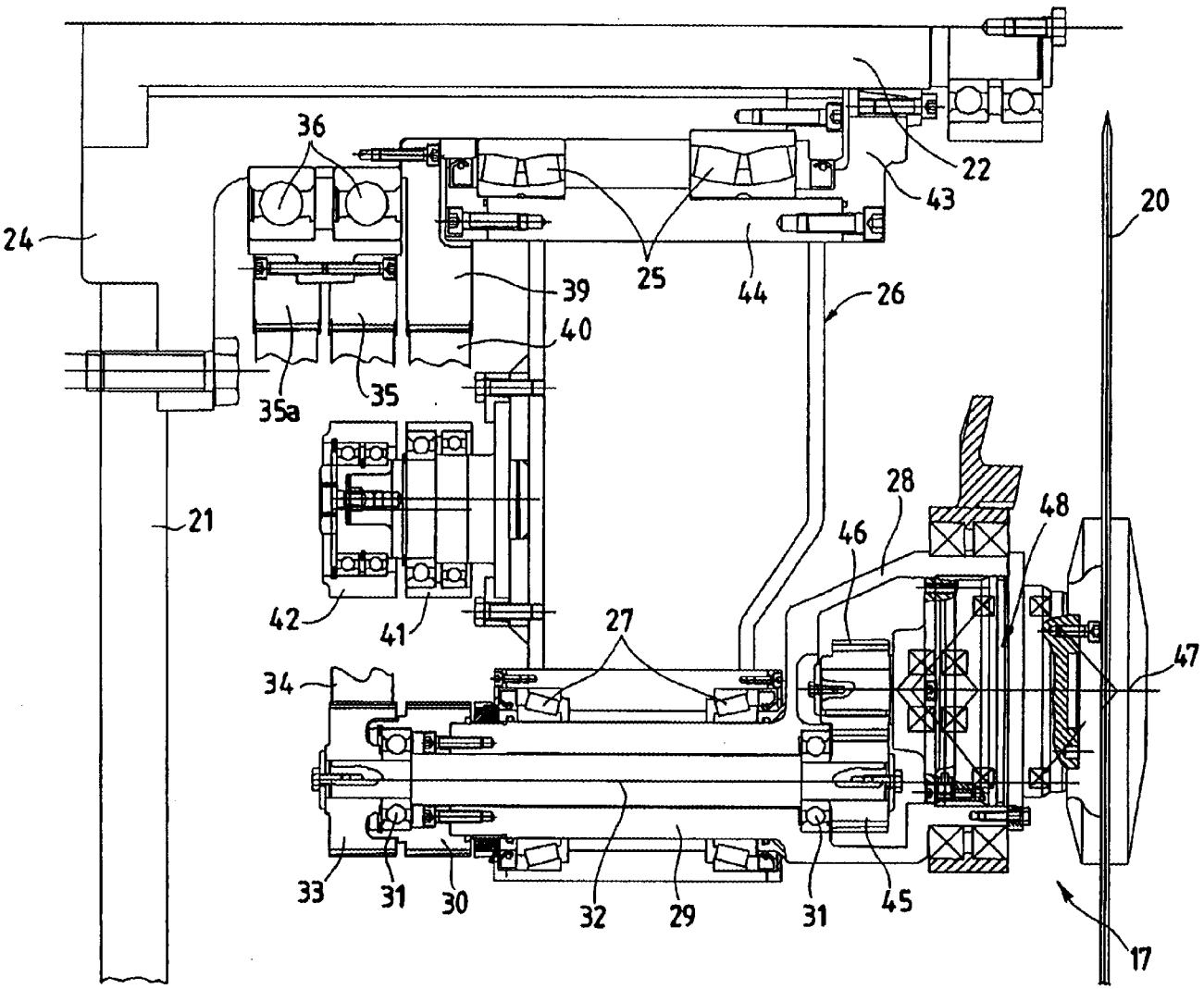
FIG. 3 is an enlarged sectional view of a detail of FIG. 2.
Figure 4:
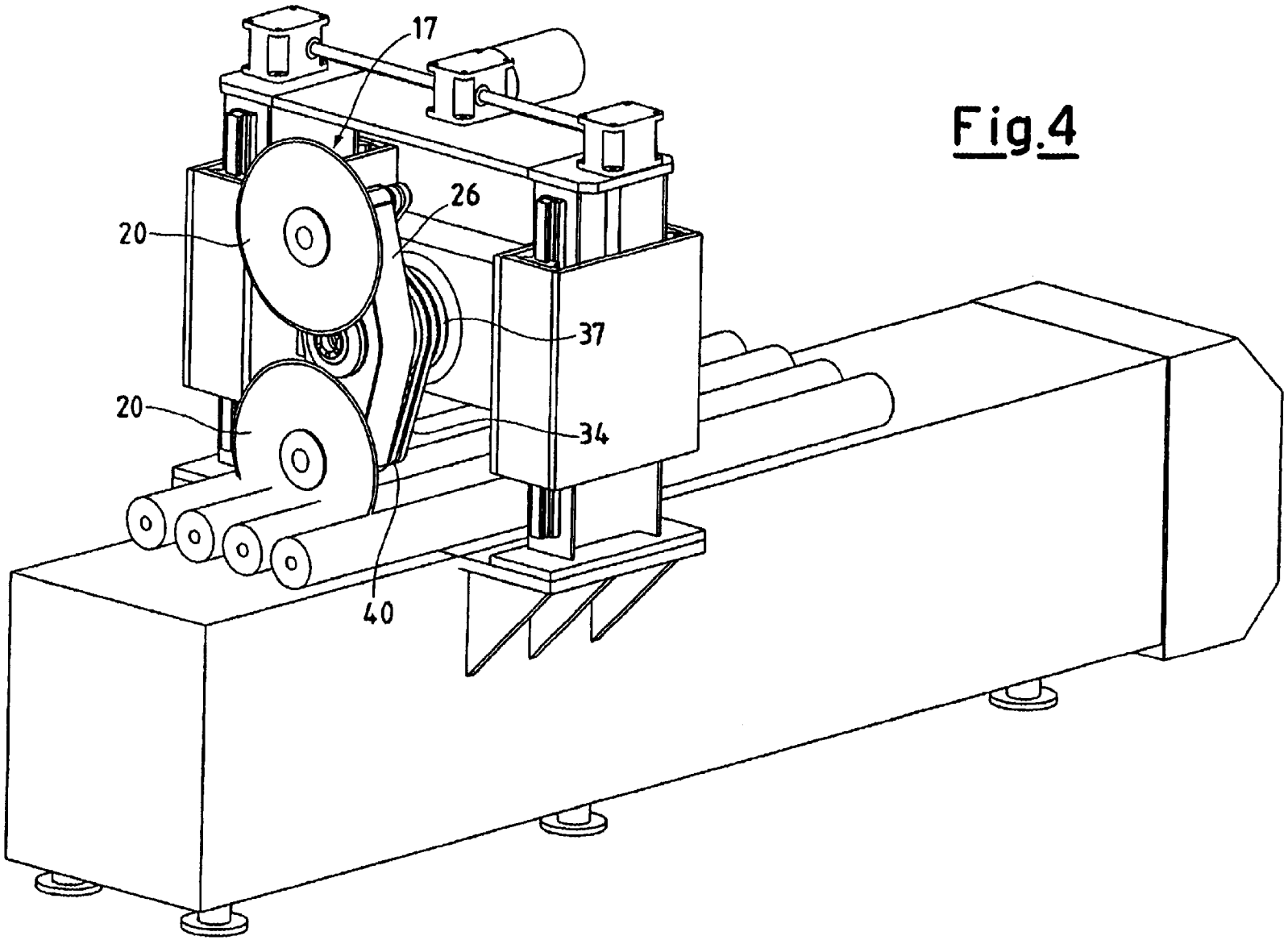
FIG. 4 is a perspective view of the head of the present invention, assembled on a machine.

For example, movement can be carried out using jacks such as that shown in 49 in FIG. 2 which envisage the rapid positioning of the parts depending on the disc diameter and/or the diameter of the log to be cut.

A cutting head, according to the invention for a cutting machine, thus solves all the problems of the previous technique and allows, in a simple and reliable manner, the processing of several rolls of any diameter, in any number, without any problems, resulting in high cutting productivity.

What is claimed is:

1. A cutting head for rolls (12) of kitchen towel or toilet paper, positioned on a cutting machine (11) on which at least two rolls (12) are conveyed step by step by a pusher conveyor, said cutting head (17) being connected to a motorized cutting disc (20), said cutting head (17) cutting said rolls (12) crosswise, said rolls (12) being set on a surface of a conveyor (14), where said rolls (12) are guided through grooves (13), wherein said cutting head (17) is connected to a rotary arm (26) affixed to sleeve (24) which is affixed to a supporting structure (21), said cutting head (17) further comprising a rotary shaft (47) for at least one cutting disc (20), said rotary shaft (47) of said cutting disc (20) being rotated by a motor (38) connected to said rotary shaft (47) by a set of gears (45, 46, 48) are supported and are eccentrically movable in relation to a drive shaft (32) while carrying out a cutting operation according to a synchronous ratio, said drive shaft (32) transmitting rotation to said cutting disc (20) and being parallel to a rotational central shaft (22) of said rotary arm (26).

2. A cutting head (17) according to claim 1, wherein said rotary arm (26) is connected to a shaped case (28, 29), movable on bearings (27), at a free end, further comprising said drive shaft (32), said shaped case (28, 29) also comprising said rotary shaft (47), said cutting disc (20) moving eccentrically in relation to said shaped case (28,29).

3. A cutting head (17) according to claim 2, wherein said set of gears (45, 46, 48) are set between said drive shaft (32) and said rotary shaft (47), wherein said gears (45, 46, 48) are housed in said case (28, 29).

4. A cutting head (17) according to claim 2, wherein said shaped case (28) comprises a sleeve extension (29) connected to a belt pulley (30) at a free end of said sleeve extension, wherein a timing belt (40) is engaged with said belt pulley (30), said timing belt further engaged wit a pulley (39) fixed and placed externally coaxial to said sleeve (24), further comprising idle tension rollers (41) affixed to said supporting structure (21), said idle tension rollers (41) assisting said timing belt (40) on an edge of said rotary arm (26), said rotary arm (26) being supported and rotationally dragged by said rotational central shaft (22), wherein said rotational central shaft (22) is free to turn in said sleeve (24), and wherein said rotational central shaft (22) is connected to a ratiomotor (23) which is integral with said supporting structure (21).

5. A cutting head (17) according to claim 1, wherein one end of said drive shaft (32) bears an integral belt pulley (33) on which a timing belt (34) is engaged which draws motion from said motor (38) connected to a belt transmission **(35, 35*a*, 37)**.

6. A cutting head (17) according to claim 5, wherein said belt transmission comprises two turning belt pulleys **(35, 35*a*) integral with each other and connected to said sleeve (24) integral with said supporting structure (21), on one of said belt pulleys (35*a*) is engaged a timing belt (37) which draws motion from said motor (38) integral with said supporting structure (21)**.

7. A cutting head (17) according to claim 1, wherein said rotary arm (26) further comprises two cutting heads (17) set on opposite sides of said rotary arm (26) in relation to said central shaft (22).

8. A cutting head (17) according to claim 1, wherein said supporting structure comprises a crossbeam (21) integral with an upper portal structure (16) which can be raised or lowered in relation to a lower structure to which said pusher conveyor is connected.

9. A cutting head (17) according to claim 1, wherein said cutting disc (20) of said cutting head (17) is operated continuously by said rotary arm (26) and by said eccentric movement of (said rotary arm (26), said cutting head moving from a release position of said two or more rolls (12) to a take up position engaged with said rolls (12) in a substantially parallel direction to the direction in which said conveyor (14) (12) moves.

10. A cutting head (17) according to claim 1, wherein said cutting disc (20) moves in a closed ring course including at least one section which is substantially straight and parallel to said conveyor surface (14).

* * * * *